US010343437B2

(12) United States Patent
Shelton et al.

(10) Patent No.: US 10,343,437 B2
(45) Date of Patent: Jul. 9, 2019

(54) ULTRAVIOLET-SENSITIVE FINISHING MARK

(71) Applicants: HEWLETT-PACKARD INDIGO B.V., Amstelveen (NL); Gerold K. Shelton, Meridian, ID (US); Shaun Henry, Middleton, ID (US)

(72) Inventors: Gerold K. Shelton, Meridian, ID (US); Shaun Henry, Middleton, ID (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/521,797

(22) PCT Filed: Dec. 18, 2014

(86) PCT No.: PCT/US2014/071098

§ 371 (c)(1),
(2) Date: Apr. 25, 2017

(87) PCT Pub. No.: WO2016/099503

PCT Pub. Date: Jun. 23, 2016

(65) Prior Publication Data

US 2017/0246896 A1 Aug. 31, 2017

(51) Int. Cl.

| | |
|---|---|
| ***B41M 3/14*** | (2006.01) |
| ***B41M 5/00*** | (2006.01) |
| ***G03G 9/12*** | (2006.01) |
| ***B41J 2/01*** | (2006.01) |
| ***G03G 15/10*** | (2006.01) |

(52) U.S. Cl.

CPC ..... *B41M 5/0023* (2013.01); *B41J 2/01* (2013.01); *B41M 3/144* (2013.01); *G03G 9/122* (2013.01); *G03G 15/10* (2013.01); *G03G 2215/0626* (2013.01); *G03G 2215/0658* (2013.01)

(58) Field of Classification Search

CPC ..... B41M 3/14; B41M 3/144; B41M 5/00; B41M 5/0023

USPC ..... 428/195.1, 916; 283/72, 85, 89, 92, 94

See application file for complete search history.

(56) References Cited

U.S. PATENT DOCUMENTS

| | | | |
|---|---|---|---|
| 4,599,958 | A | 7/1986 | Stiers |
| 6,370,844 | B1 | 4/2002 | Stricker |
| 6,499,513 | B1 | 12/2002 | Couch |
| 2002/0063744 | A1 | 5/2002 | Stephens, Jr. |
| 2006/0230273 | A1 | 10/2006 | Crichton |
| 2012/0049506 | A1 | 3/2012 | Nikkila |
| 2012/0156509 | A1 | 6/2012 | Mente et al. |
| 2014/0087306 | A1 | 3/2014 | Blomquist et al. |
| 2014/0339808 | A1 | 11/2014 | Pawlik et al. |

OTHER PUBLICATIONS

Zadbuke, N. et al. "Recent Trends and Future of Pharmaceutical Packaging Technology", Apr.-Jun. 2013, Available at: http://www.ncbi.nlm.nih.gov/pmc/articles/PMC3697200/.

*Primary Examiner* — Bruce H Hess

(74) *Attorney, Agent, or Firm* — HP Inc. Patent Department

(57) ABSTRACT

Example implementations relate to a printing an image on a substrate and printing an ultraviolet-sensitive finishing mark on the substrate using ultraviolet-sensitive ink. The ultraviolet-sensitive finishing mark can be visible under ultraviolet light.

16 Claims, 5 Drawing Sheets

ULTRAVIOLET-SENSITIVE FINISHING MARK

CROSS-REFERENCE TO RELATED APPLICATION

This application is a U.S. National Stage Application of and claims priority to International Patent Application No. PCT/US2014/071098, filed on Dec. 18, 2014, and entitled "ULTRAVIOLET-SENSITIVE FINISHING MARK."

BACKGROUND

Printed media can be finished by a variety of processes such as cutting, folding, varnishing, and embossing, among others. Finishing marks, such as cut marks, fold marks, and crop marks, are printed in the edges or in the gutters of the printed media to provide instruction to print finishing workers and finishing devices.

BRIEF DESCRIPTION OF THE DRAWINGS

Various examples will be described below with reference to the following figures.

DETAILED DESCRIPTION

Printed media, which can include text, graphics, and the like printed on a substrate such as paper, plastic, film, or metal, can be finished by a variety of processes such as cutting, folding, varnishing, and embossing, among others. Finishing marks, such as cut marks (also known as crop marks) and fold marks, are printed in the edges or in the gutters of the printed media to provide instruction to print finishing workers and to finishing devices. For example, multiple business cards may be printed with cut marks on a single sheet, and that single sheet subsequently may be finished on a cutting machine by cutting according to the cut marks in order to produce individual business cards.

However, the finishing marks are generally printed with visible ink in the edges or the gutters of the printed media so as to not interfere with the text or graphics of the printed media, which can limit print size options and also result in excessive waste. Additionally, in some instances, finishing marks are applied in bulk to printed media in a separate operation following the printing, and moreover, the tooling to apply the finishing marks is fixed (i.e., non-customizable).

The term "inkjet printing" as used herein refers to a class of printing technologies that can use pressure pulses to propel droplets of ink from a cartridge head on to a substrate to print an image. In some implementations, the pressure pulses can be generated by thermal heating and vaporization of ink in the cartridge head. In other implementations, the pressure pulses can be generated by piezoelectric vibrations in the cartridge head.

The term "liquid electrophotographic printing" as used herein refers to a process of printing a liquid toner using an electric field. Liquid electrophotographic printing involves placing a uniform electrostatic charge on a photoconductor (such as a photoconductive surface on a rotating drum) and exposing the photoconductor to light in the pattern of the desired printed image to dissipate the charge on the areas of the photoconductor exposed to the light. The resulting latent electrostatic image on the photoconductor is developed by applying a thin layer of liquid toner to the photoconductor. Liquid toner typically comprises charged toner particles dispersed in a carrier liquid. In some implementations, the charged toner particles adheres to charged areas on the photoconductor to form the desired toner image on the photoconductor. The toner image is transferred from the photoconductor to an intermediate transfer member and then from the intermediate transfer member to the substrate.

The term "ultraviolet-sensitive" as used herein describes a characteristic of an object to fluoresce (or to otherwise becomes more visible) when illuminated by ultraviolet light (e.g., light in a wavelength range of less than or equal to approximately 400 nm).

Figure 1:
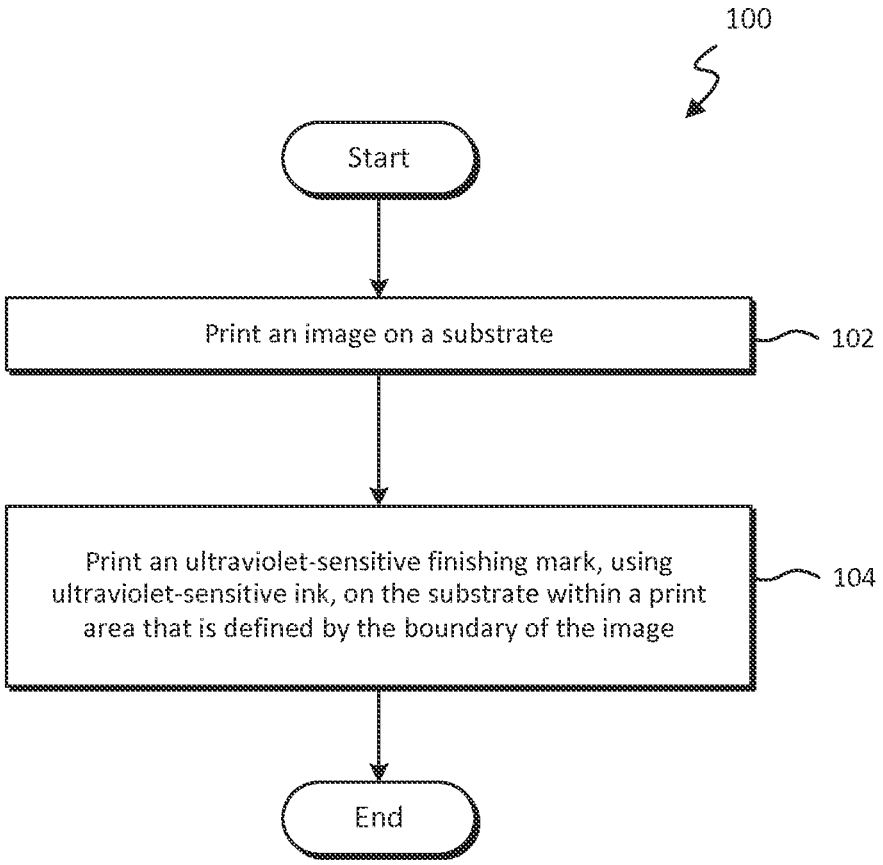
FIG. 1 is a flow diagram of an example method for printing an ultraviolet-sensitive finishing mark according to an implementation.

Referring now to the figures, FIG. 1 is a flow diagram of a method 100 for printing an ultraviolet-sensitive finishing mark according to an implementation. In some implementations, the method 100 may be performed by a print system, such as the print system 300 of FIG. 3, which will be described further herein below. In some implementations, the method 100 may be implemented, at least in part, in the form of executable instructions stored on a machine-readable medium and/or in the form of electronic circuitry. In some implementations, the steps of method 100 may be executed substantially concurrently or in a different order than shown in FIG. 1. In some implementations, method 100 may include more or less steps than are shown in FIG. 1. In some implementations, one or more of the steps of method 100 may, at certain times, be ongoing and/or may repeat.

At block 102, a print system prints an image on a substrate. For example, the image can be text, a graphic, a figure, a picture, and/or the like. In some examples, an image may include white space, that is, an area of the substrate is to be left unprinted (e.g., white space may be used for purposes such as aesthetics or emphasis). In some implementations, the image can be printed edge-to-edge on the substrate (also known as full bleed printing). In some implementations, the image is printed with visible ink, that is, ink that is visible (i.e., perceivable by human eyes or electronic imaging sensors) under visible-spectrum light (e.g., light in a wavelength range of approximately 400 nm to approximately 700 nm or greater). Accordingly, the image may also be called a visible image.

At block 104, the print system prints an ultraviolet-sensitive finishing mark, using ultraviolet-sensitive ink, on the substrate within a print area that is defined by a boundary of the image printed at block 102. The ultraviolet-sensitive finishing mark printed at block 104 is a finishing mark that is visible (i.e., perceivable by human eyes or electronic imaging sensors) under ultraviolet light (e.g., light in a wavelength range of less than or equal to approximately 400 nm). As described above, a finishing mark provides finishing instructions to a print finishing worker or a finishing device. In some implementations, the ultraviolet-sensitive finishing mark can be a cut mark, a fold mark, a barcode, a finishing instruction, and/or the like. The finishing instruction can, for example, provide readable instructions, such as instructions to apply a varnish, apply a lamination, apply a foil stamp, emboss, letterpress, or the like. In some implementations, the ultraviolet-sensitive finishing mark can be a watermark. It should be understood that the ultraviolet-sensitive finishing mark can comprise a plurality of the foregoing marks.

In some implementations, the ultraviolet-sensitive finishing mark is visible under ultraviolet light by virtue of being printed using ultraviolet-sensitive ink, which is visible under ultraviolet light. More particularly, the ultraviolet-sensitive ink (and thus the ultraviolet-sensitive finishing mark) is visible under ultraviolet light because the ultraviolet-sensitive ink fluoresces under ultraviolet light. In some implementations, the ultraviolet-sensitive ink is non-opaque.

As described above, the ultraviolet-sensitive finishing mark is printed at block 104 within a print area defined by a boundary of the image printed by block 102. In other words, the print area can be the area of the substrate where the image is printed (or is to be printed, in an implementation where method 100 is performed in a different order than illustrated in FIG. 1), including white space. In implementations where the image is printed edge-to-edge, the print area also is edge-to-edge, that is, the print area extends from a first edge of the substrate to a second edge of the substrate. In some implementations, an ultraviolet-sensitive finishing mark also can be printed outside the print area.

The print system described above can implement any printing technique suitable for performing blocks 102 and 104. For example, blocks 102 or 104 can be performed by liquid electrophotographic printing, and the visible ink and the ultraviolet-sensitive ink can be liquid toners that can be held in separate liquid toner tanks. In other implementations, blocks 102 or 104 can be performed by inkjet printing, and the visible ink and the ultraviolet-sensitive ink can be held in ink cartridges. The substrate referred to in method 100 can be, for example, any medium on which the print system can print. For example, the substrate can be an absorbable medium, such as paper or card stock, for both liquid electrophotographic printing and inkjet printing. As another example, liquid electrophotographic printing can be used to perform method 100 on plastic, film, or metal substrates.

Figure 2:
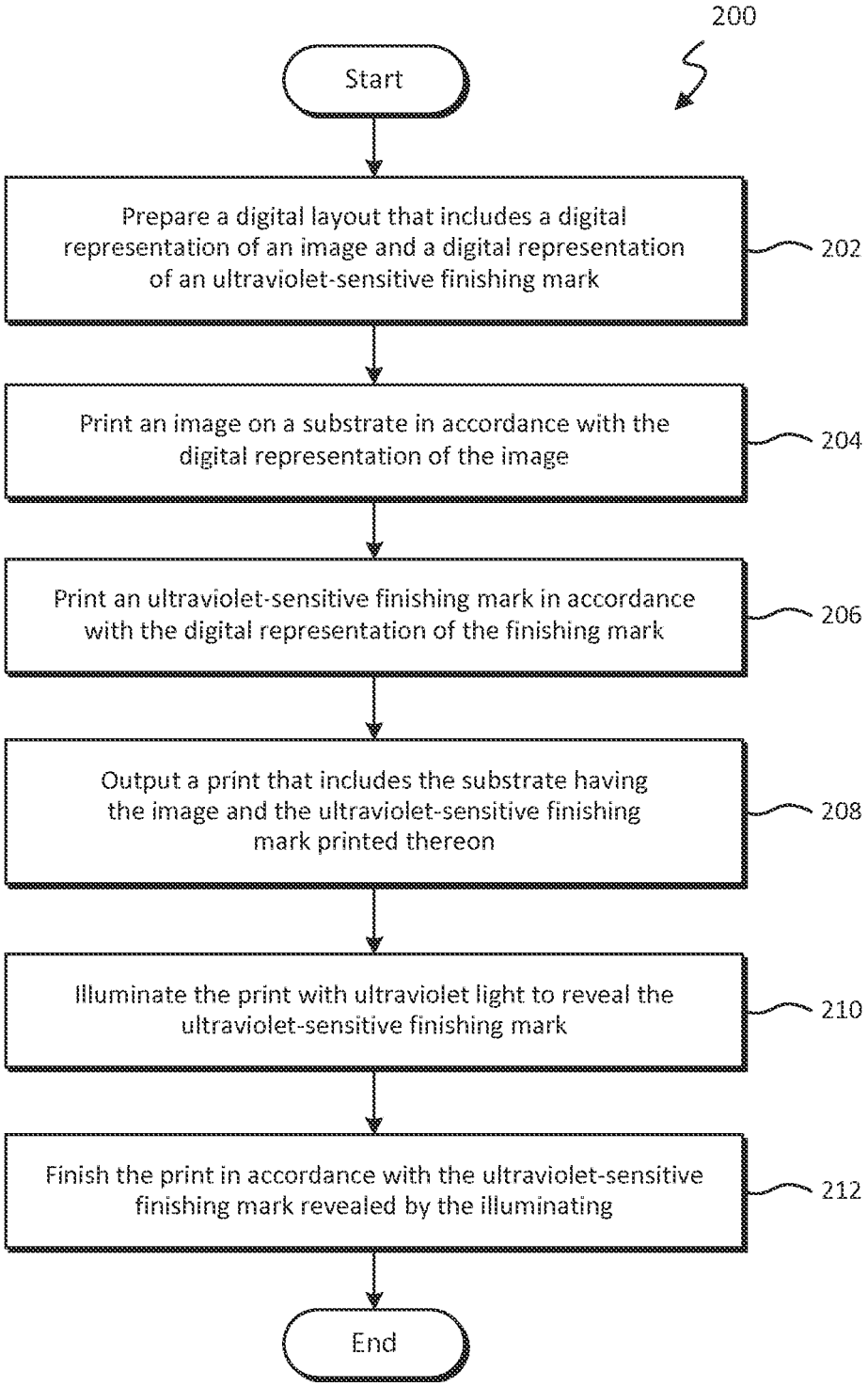
FIG. 2 is a flow diagram of an example method for printing an ultraviolet-sensitive finishing mark according to another implementation.

FIG. 2 is a flow diagram of a method 200 for printing an ultraviolet-sensitive finishing mark according to another implementation. In some implementations, the method 200 may be performed by a print system, such as the print system 400 of FIG. 4, which will be described further herein below. In some implementations, the method 200 may be implemented, at least in part, in the form of executable instructions stored on a machine-readable medium and/or in the form of electronic circuitry. In some implementations, the steps of method 200 may be executed substantially concurrently or in a different order than shown in FIG. 2. In some implementations, method 200 may include more or less steps than are shown in FIG. 2. In some implementations, one or more of the steps of method 200 may, at certain times, be ongoing and/or may repeat.

At block 202, the print system prepares a digital layout that includes a digital representation of an image and a digital representation of an ultraviolet-sensitive finishing mark. For example, at block 202, the print system can receive user input (e.g., via a keyboard, a pointing device such as a mouse or stylus, a touchscreen, and/or the like) that virtually indicates (e.g., on a screen or display) a relative placement on a substrate of an ultraviolet-sensitive finishing mark and an image, the ultraviolet-sensitive finishing mark and the image to be physically printed on the substrate by the print system at a subsequent step of method 200 (e.g., at blocks 204 and 206).

At block 204, the print system prints an image on a substrate in accordance with the digital representation of the image prepared as part of the digital layout at block 202, such that the printed image and the digital representation of the image are substantially similar in appearance. Block 204 can print the image in a manner analogous to the image printing of block 102 of method 100. As with block 102, at block 204, the image can be printed edge-to-edge and can be printed with visible ink.

At block 206, the print system prints an ultraviolet-sensitive finishing mark in accordance with the digital representation of the ultraviolet-sensitive finishing mark prepared as part of the digital layout at block 202, such that the printed ultraviolet-sensitive finishing mark and the digital representation of the ultraviolet-sensitive finishing mark are substantially similar in appearance. The ultraviolet-sensitive finishing mark can be printed at block 206 in a manner analogous to the printing at block 104 of method 100 (i.e., the ultraviolet-sensitive finishing mark can be printed, using ultraviolet-sensitive ink, on the substrate within a print area that is defined by the boundary of the image).

At block 208, the print system outputs a print that includes the substrate having printed thereon the image printed at block 204 and the ultraviolet-sensitive finishing mark printed at block 206. In some implementations, the print system prints the ultraviolet-sensitive finishing mark on top of (i.e., overlapping) the image printed at block 204. In some implementations, the ultraviolet-sensitive ink can be non-opaque. By virtue of the ultraviolet-sensitive ink being non-opaque and the ultraviolet-sensitive finishing mark being visible under ultraviolet light (as described above with reference to FIG. 1), the image can be substantially visible under visible-spectrum light without being obscured by finishing marks printed on top of the image. In some implementations, the ultraviolet-sensitive finishing mark can be substantially invisible when not illuminated by (or in other words, exposed to or viewed under) ultraviolet light.

At block 210, the print system illuminates the print outputted at block 208 with ultraviolet light to reveal (i.e., to make visible) the ultraviolet-sensitive finishing mark. For example, ultraviolet light can be emitted by an ultraviolet light source, such as an ultraviolet lamp. As discussed above with respect to FIG. 1, the ultraviolet-sensitive ink used to print the ultraviolet-sensitive finishing mark can fluoresce under ultraviolet light. Accordingly, by virtue of the fluorescence, the ultraviolet-sensitive finishing mark can become visible at block 210 under ultraviolet light.

At block 212, the print system finishes the print in accordance with the ultraviolet-sensitive finishing mark revealed by ultraviolet illumination at block 210. As described above with reference to FIG. 1, the ultraviolet-sensitive finishing mark may include a cut mark, a fold mark, a barcode, a finishing instruction, and/or the like. Print finishing can be performed by a print finishing worker and/or a manual, semi-automated, or automated finishing device, which may have image sensors that read the ultraviolet-sensitive finishing mark revealed under ultraviolet light. In some implementations, block 212 can be performed by a print finishing worker in the vicinity of ultraviolet light, because the visibility of the ultraviolet-sensitive finishing mark may be reduced if the intensity of ultraviolet light illuminating the print is reduced.

Figure 3:
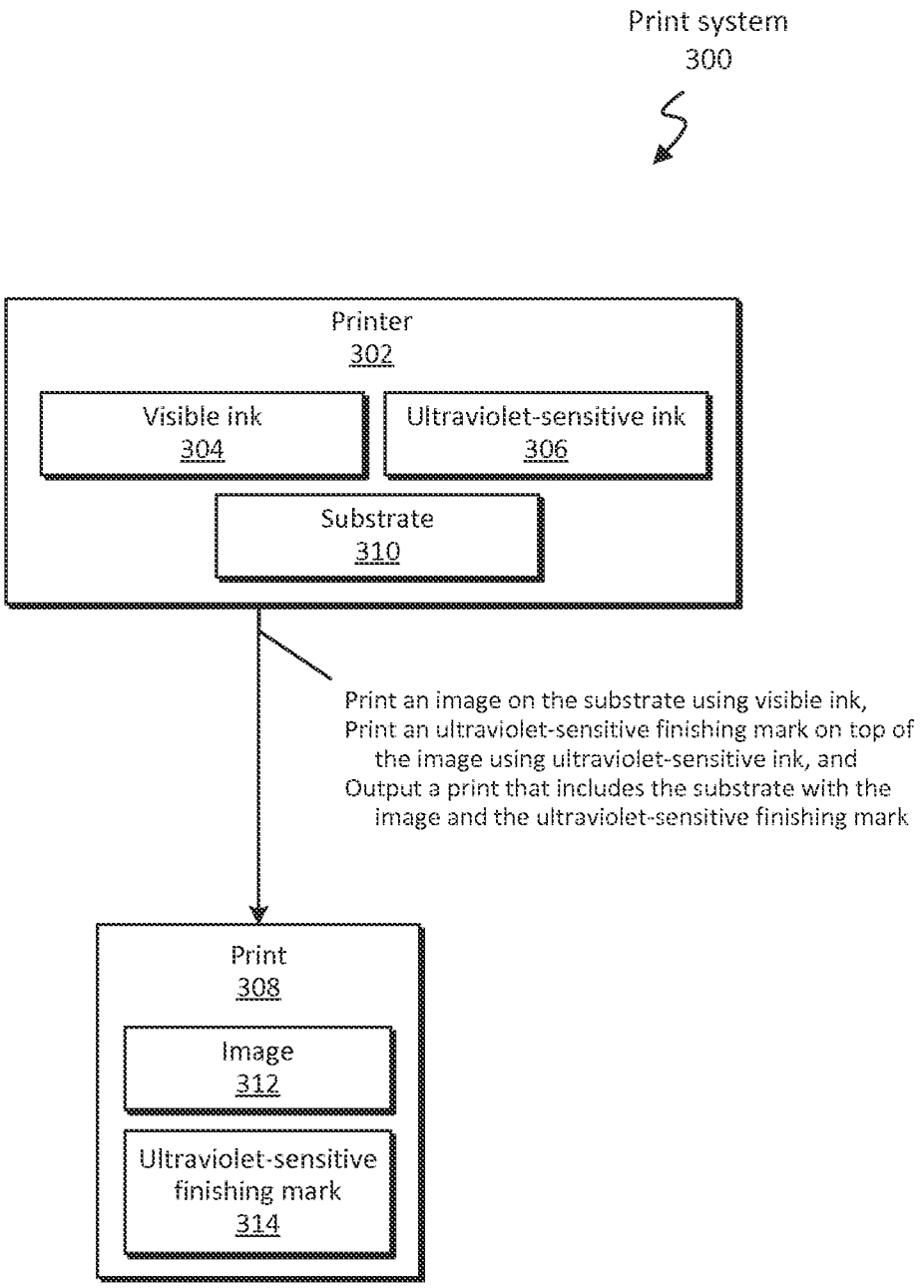
FIG. 3 is a block diagram of an example device for printing an ultraviolet-sensitive finishing mark according to an implementation.

FIG. 3 is a block diagram of an example print system 300 according to some implementations that includes a printer 302. The printer 302 includes visible ink 304 and ultraviolet-sensitive ink 306. The printer 302 prints an image 312 on a substrate 310 using the visible ink 304 and prints an ultraviolet-sensitive finishing mark 314 using the ultraviolet-sensitive ink 306. In some implementations, the printer 302 prints the ultraviolet-sensitive finishing mark 314 on the substrate on top of the image 312. In some implementations, the printer 302 prints the ultraviolet-sensitive finishing mark 314, on the substrate 310 within a print area that is defined by the boundary of the image 312. The print area can be the area of the substrate where the image 312 is to be printed, including white space. Accordingly, the printer 302 can output a print 308 that includes the substrate 310 having printed thereon the image 312 and the ultraviolet-sensitive finishing mark 314, An example of print 308 will be described further herein with reference to FIGS. 5A and 5B.

In some implementations, the printer 302 can be a liquid electrophotographic printer, and the visible ink 304 and the ultraviolet-sensitive ink 306 can be liquid toners that can be contained in separate liquid toner tanks. In some implementations, the printer 302 can be an inkjet printer, and the visible ink 304 and the ultraviolet-sensitive ink 306 can be contained in separate ink cartridges. Other printer technologies may be suitable to implement as the printer 302. In some implementations, the printer 302 produces the print 308 by performing at least part of method 100 or the method 200.

In some implementations, the visible ink 304 is visible (i.e., perceivable by human eyes or electronic imaging sensors) under visible-spectrum light. The visible ink 304 can use, for example, a cyan-magenta-yellow-key(black) (CMYK) color gamut, a CMYK-orange-green color gamut, a CMYK-orange-violet-green color gamut, or the like. In some implementations, the ultraviolet-sensitive ink 306 is visible under ultraviolet light, and accordingly, the ultraviolet-sensitive finishing mark 314 printed by the ultraviolet-sensitive ink 306 can be visible under ultraviolet light. Additionally, the ultraviolet-sensitive ink 306 can be non-opaque, and the ultraviolet-sensitive finishing mark 314 can be substantially invisible when not illuminated by ultraviolet light. In some implementations, the ultraviolet-sensitive finishing mark 314 can be a cut mark, a fold mark, a barcode, a finishing instruction, and/or the like. In some implementations, the ultraviolet-sensitive finishing mark 314 can be a watermark. It should be understood that the ultraviolet-sensitive finishing mark 314 can comprise a plurality of the foregoing marks.

Figure 4:
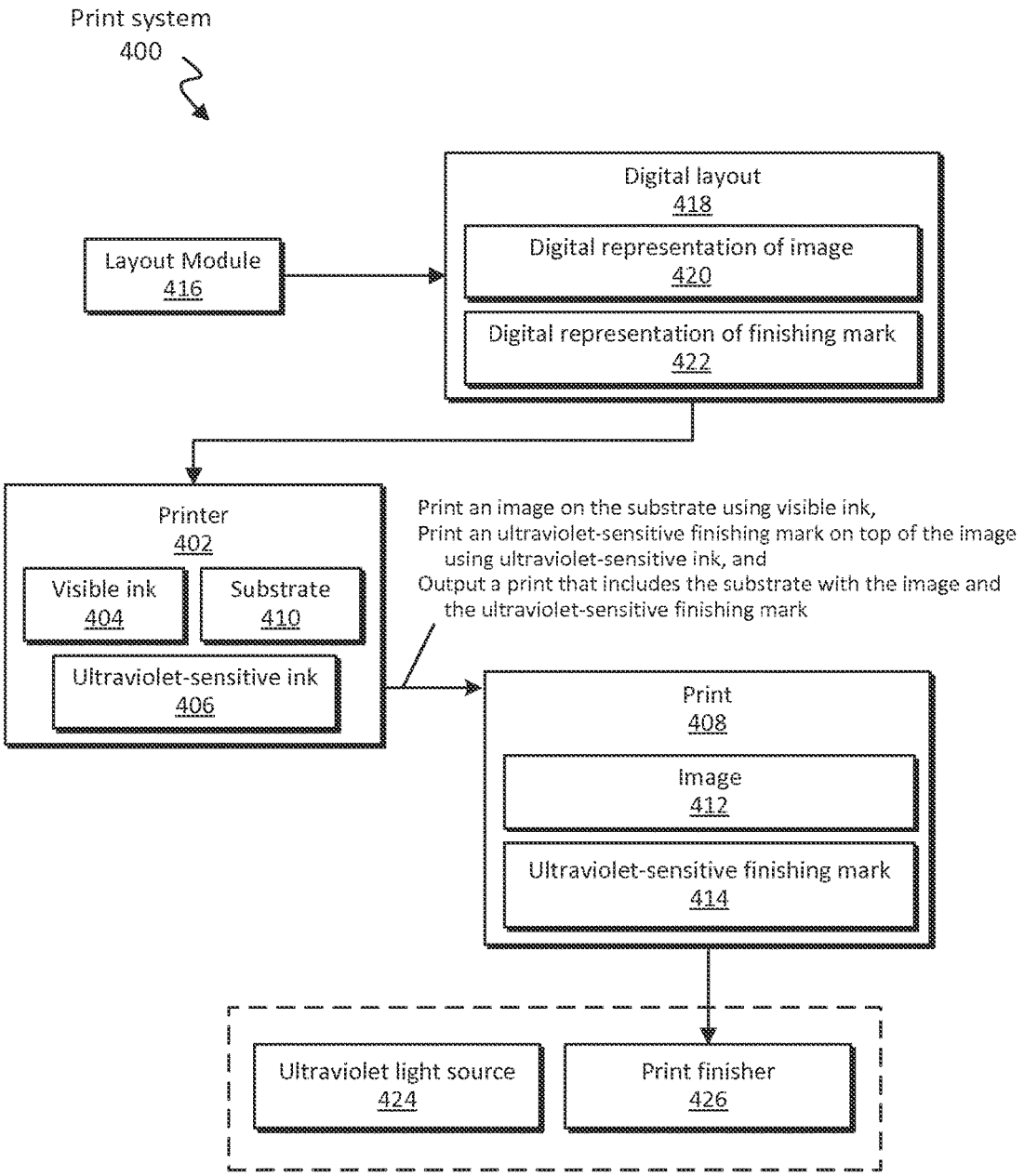
FIG. 4 is a block diagram of an example device for printing an ultraviolet-sensitive finishing mark according to another implementation.

FIG. 4 is a block diagram of an example print system 400 according to some implementations that can include a printer 402 and a layout module 416. In some implementations, the print system 400 can also include an ultraviolet light source 424 and a print finisher 426. The printer 402 can be analogous in many respects to the printer 302 of FIG. 3.

The layout module 416 can include a set of instructions encoded on a machine-readable medium and executable by a processor of an electronic device, such as a laptop computer, a desktop computer, a workstation, a mobile phone, a tablet computing device, a wearable computing device, a server, and the like. Additionally or alternatively, the layout module 416 can include a hardware device comprising electronic circuitry for implementing the functionality described below. The layout module 416 can prepare a digital layout 418 that includes a digital representation of the image 420 and a digital representation of the ultraviolet-sensitive finishing mark 422. In some implementations, the layout module 416 can prepare the digital layout 418 by performing at least part of the method 200, and more particularly, by performing block 202 of the method 200. In some implementations, the digital layout 418 prepared by the layout module 416 can be transmitted to the printer 402 (or in other words, the digital layout 418 can be received by the printer 402) by, for example, any wired or wireless network.

As with the printer 302, the printer 402 can include visible ink 404 and ultraviolet-sensitive ink 406. Like the printer 302, the printer 402 can produce a print 408 by printing an image 412 on a substrate 410 using the visible ink 404 and by printing an ultraviolet-sensitive finishing mark 414 using the ultraviolet-sensitive ink 406 on the substrate 410, either on top of the image 412 or within a print area that is defined by the boundary of the image 412. In some implementations, the print 408 is produced in accordance with the digital layout 418. More particularly, the printer 402 can print the image 412 in accordance with the digital representation of the image 420 (e.g., by performing step 204 of method 200), and can print the ultraviolet-sensitive finishing mark 414 in accordance with the digital representation of the ultraviolet-sensitive finishing mark 422 (e.g., by performing step 206 of method 200). Accordingly, the printer 402 can output a print 408 that includes the substrate 410 having printed thereon the image 412 and the ultraviolet-sensitive finishing mark 414, An example of the print 408 will be described further herein with reference to FIGS. 5A and 5B.

The ultraviolet light source 424 can be a light source that emits ultraviolet light in a wavelength range of less than or equal to approximately 400 nm. In some implementations, the ultraviolet light source 424 can emit ultraviolet light that makes the ultraviolet-sensitive finishing mark 414 visible. For example, as described above with respect to blocks 208 and 210 of method 200, the ultraviolet-sensitive finishing mark 414 may be substantially invisible when not illuminated by ultraviolet light, such that an image 412 can be visible without being obscured by an ultraviolet-sensitive finishing mark 414 printed on top of or around the image 412. When illuminated by ultraviolet light, the ultraviolet-sensitive finishing mark 414 can become visible (e.g., is revealed), by virtue of, for example, a fluorescence of the ultraviolet-sensitive finishing mark 414 printed using the ultraviolet-sensitive ink 406.

The print finisher 426 can receive the print 408 and finish the print 408 in accordance with the ultraviolet-sensitive finishing mark 414 made visible by ultraviolet light emitted by the ultraviolet light source 424. For example, the print finisher 426 can be a folder, a cutter, a slitter, and/or a creaser, and such examples are non-limiting. In some implementations, the print finisher 426 can be a manually operated device, a semi-automated device, or a fully automated device.

In some implementations, the ultraviolet light source 424 and the print finisher 426 can be located within the same vicinity, as represented by the dashed box surrounding the ultraviolet light source 424 and the print finisher 426 in FIG. 4, such that ultraviolet light from the ultraviolet light source 424 can illuminate the print 408 being finished at the print finisher 426 without obstruction.

Figure 5A:
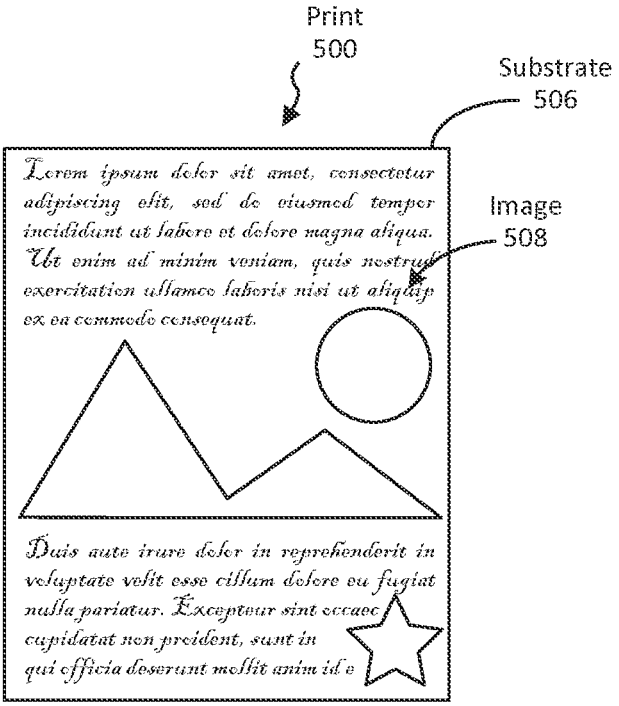
FIG. 5A is an illustration of an example print, having an ultraviolet-sensitive finishing mark, not viewed under ultraviolet light.
Figure 5B:
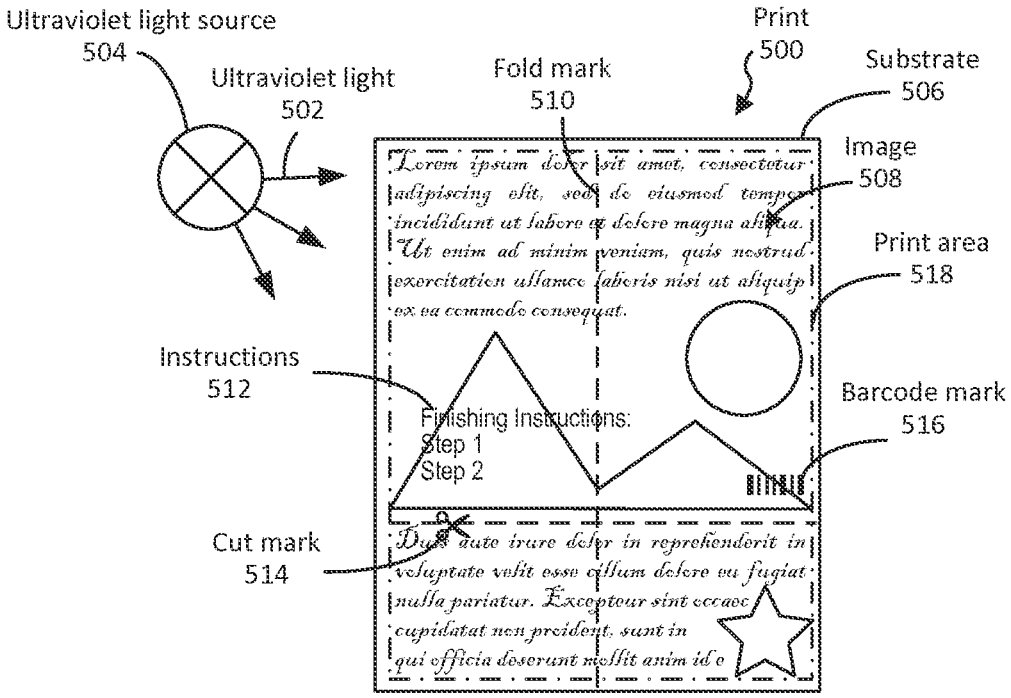
FIG. 5B is an illustration of the example print of FIG. 5A viewed under ultraviolet light.

FIGS. 5A and 5B collectively illustrate an example print 500 that can be printed, for example, by the print system 300 or the print system 400 performing the method 100 or the method 200, respectively. In particular, FIG. 5A illustrates the print 500 as viewed substantially without illumination by ultraviolet light when not viewed under ultraviolet light), and FIG. 5B illustrates the print 500 as viewed under ultraviolet light 502 emitted by an ultraviolet light source 504. The print 500 can be an example of the print 308 of FIG. 3 or the print 408 of FIG. 4.

The print 500 can include a substrate 506 and an image 508 printed on the substrate 506, as shown in FIG. 5A. The substrate 506 and the image 508 of the print 500 can be analogous to the substrate and the image described above with respect to FIGS. 1-4. For example, in FIG. 5A, the image 508 includes text and graphics (as well as white space between the text and the graphics), although this example is non-limiting. The substrate 506 can be, for example, paper, card stock, plastic, film, or metal, among other printable substrates.

The print 500 also can include an ultraviolet-sensitive finishing mark printed on the substrate 506 in a print area that is defined by the boundary of the image. In some implementations, the ultraviolet-sensitive finishing mark is visible, or can become visible, under ultraviolet light. In some implementations, the ultraviolet-sensitive finishing marks can be deemed substantially invisible when not viewed under ultraviolet light. Accordingly, ultraviolet-sensitive finishing marks included in the print 500 are not illustrated in FIG. 5A, because FIG. 5A illustrates the print 500 as viewed substantially without ultraviolet light.

On the other hand, FIG. 5B illustrates ultraviolet-sensitive finishing marks included in the print 500, because FIG. 5B illustrates the print 500 as viewed under ultraviolet light 502. FIG. 5B illustrates non-limiting examples of ultraviolet-sensitive finishing marks, including a fold mark 510, instructions 512, a cut mark 514, and a barcode mark 516, each of which is visible under ultraviolet light 502, but may be substantially invisible when not viewed under ultraviolet light as illustrated in FIG. 5A). It should be understood that the ultraviolet-sensitive finishing mark(s) of a print, such as print 500, need not include each of the fold mark 510, the instructions 512, the cut mark 514, and the barcode mark 516 shown in FIG. 5B, as the foregoing marks are merely non-limiting examples. The ultraviolet-sensitive finishing marks can be examples of the ultraviolet-sensitive finishing mark described above with reference to FIGS. 1-4. As shown in FIG. 5B, the fold mark 510, the instructions 512, the cut mark 514, and the barcode mark 516 are printed in a print area 518 that is defined by the boundary of the image 508. The print area 518 is represented in FIG. 5B by a dash-dot outline for the purposes of illustration only, and it should be understood that the dash-dot boundary itself is not printed and does not form a part of the print 500, regardless of whether the print 500 is viewed under ultraviolet light 502.

In view of the foregoing description, it can be appreciated that ultraviolet-sensitive finishing marks can be printed together with an image in a unique way to form a printed media that is ready to undergo a finishing process such as folding, cutting, and the like. By virtue of the ultraviolet-sensitive finishing marks being visible under ultraviolet light and being substantially invisible when not viewed under ultraviolet light, the finishing marks can be printed on top of or in substantially the same area as the image of the printed media. Accordingly, the printed media can be printed edge-to-edge on a greater number of substrate and print size options, and waste can be reduced. Additionally, by virtue of preparing the placement of the ultraviolet-sensitive finishing marks in a digital layout, finishing marks can be highly customizable, and in some examples, the finishing marks can be individualized on a per print basis. Moreover, ultraviolet-sensitive finishing marks can be printed together with an image during the same print operation, which may increase overall efficiency and speed of a printing and publication process.

In the foregoing description, numerous details are set forth to provide an understanding of the subject matter disclosed herein. However, implementation may be practiced without some or all of these details. Other implementations may include modifications and variations from the details discussed above. It is intended that the following claims cover such modifications and variations.

We claim:

1. A print system comprising:

a processor;

a non-transitory storage medium storing instructions executable on the processor to prepare a digital layout including a digital representation of an image and a digital representation of an ultraviolet-sensitive finishing mark; and a printer to use visible ink and non-opaque ultraviolet-sensitive ink, wherein the printer is to:

receive the digital layout;

print the image on a substrate using the visible ink according to the digital representation of the image in the digital layout, print the ultraviolet-sensitive finishing mark on the substrate on top of the image using the ultraviolet-sensitive ink according to the digital representation of the ultraviolet-sensitive finishing mark in the digital layout, and output a print that includes the substrate having printed thereon the image and the ultraviolet-sensitive finishing mark to a finisher device to apply a finishing operation on the substrate in response to detection of the printed ultraviolet-sensitive finishing mark, wherein the ultraviolet-sensitive finishing mark is visible under ultraviolet light.

2. The print system of claim 1, wherein the printer is a liquid electrophotographic printer.

3. The print system of claim 1, wherein the printer is an inkjet printer.

4. The print system of claim 1, further comprising:

an ultraviolet light source to output the ultraviolet light to make visible the ultraviolet-sensitive finishing mark under the ultraviolet light; and the finisher device to finish the print in accordance with the ultraviolet-sensitive finishing mark made visible by the ultraviolet light from the ultraviolet light source.

5. The print system of claim 4, wherein the ultraviolet-sensitive finishing mark is one of a cut mark and a fold mark, and the finisher device is to cut or fold the substrate based on detection of the cut mark or fold mark, respectively, under the ultraviolet light.

6. The print system of claim 4, wherein the finisher device is to apply a varnish or lamination on the substrate in response to detection of the ultraviolet-sensitive finishing mark under the ultraviolet light.

7. The print system of claim 4, wherein the finisher device is to apply a stamp or emboss on the substrate in response to detection of the ultraviolet-sensitive finishing mark under the ultraviolet light.

8. The print system of claim 1, wherein the ultraviolet-sensitive finishing mark is a cut mark to cause the finisher device to cut the substrate based on detection of the cut mark under the ultraviolet light.

9. The print system of claim 1, wherein the ultraviolet-sensitive finishing mark is a fold mark to cause the finisher device to fold the substrate based on detection of the fold mark under the ultraviolet light.

10. The print system of claim 1, wherein the ultraviolet-sensitive finishing mark is to cause the finisher device to apply a varnish or lamination on the substrate based on detection of the ultraviolet-sensitive finishing mark under the ultraviolet light.

11. The print system of claim 1, wherein the ultraviolet-sensitive finishing mark is to cause the finisher device to apply a stamp or emboss on the substrate based on detection of the ultraviolet-sensitive finishing mark under the ultraviolet light.

12. A print system comprising:

a printer to use visible ink and non-opaque ultraviolet-sensitive ink, wherein the printer is to:

print an image on a substrate using the visible ink, print an ultraviolet-sensitive finishing mark on the substrate on top of the image using the ultraviolet-sensitive ink, and output a print that includes the substrate having printed thereon the image and the ultraviolet-sensitive finishing mark to a finisher device to apply a finishing operation on the substrate in response to detection of the printed ultraviolet-sensitive finishing mark, wherein the ultraviolet-sensitive finishing mark is visible under ultraviolet light; and a layout module to prepare a digital layout that includes a digital representation of the image and a digital representation of the ultraviolet-sensitive finishing mark, wherein the printer is to receive the digital layout and produce the print in accordance with the digital layout.

13. The print system of claim 12, further comprising:

an ultraviolet light source to output the ultraviolet light to make visible the ultraviolet-sensitive finishing mark under the ultraviolet light; and the finisher device to finish the print in accordance with the ultraviolet-sensitive finishing mark made visible by the ultraviolet light from the ultraviolet light source.

14. The print system of claim 13, wherein the finisher device is to apply a varnish or lamination on the substrate in response to detection of the ultraviolet-sensitive finishing mark under the ultraviolet light.

15. The print system of claim 13, wherein the finisher device is to apply a stamp or emboss on the substrate in response to detection of the ultraviolet-sensitive finishing mark under the ultraviolet light.

16. The print system of claim 13, wherein the ultraviolet-sensitive finishing mark is one of a cut mark and a fold mark, and the finisher device is to cut or fold the substrate based on detection of the cut mark or fold mark, respectively, under the ultraviolet light.

* * * * *